US011988438B2

(12) United States Patent
Wang et al.

(10) Patent No.: US 11,988,438 B2
(45) Date of Patent: May 21, 2024

(54) REFRIGERATOR DOOR WITH REPLACEABLE DOOR PANEL

(71) Applicants: CHONGQING HAIER REFRIGERATION ELECTRIC APPLIANCE CO., LTD., Chongqing (CN); QINGDAO HAIER REFRIGERATOR CO., LTD, Qingdao (CN); HAIER SMART HOME CO., LTD., Qingdao (CN)

(72) Inventors: Wenchun Wang, Qingdao (CN); Hao Zhang, Qingdao (CN); Jiaming Li, Qingdao (CN); Xuan Ji, Qingdao (CN)

(73) Assignees: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 18/013,244

(22) PCT Filed: Jun. 18, 2021

(86) PCT No.: PCT/CN2021/100884

§ 371 (c)(1),
(2) Date: Dec. 27, 2022

(87) PCT Pub. No.: WO2022/001699

PCT Pub. Date: Jan. 6, 2022

(65) Prior Publication Data

US 2023/0258386 A1 Aug. 17, 2023

(30) Foreign Application Priority Data

Jun. 30, 2020 (CN) ..... 202010623485.5

(51) Int. Cl.
*F25D 23/02* (2006.01)

(52) U.S. Cl.
CPC ..... *F25D 23/028* (2013.01); *F25D 23/02* (2013.01); *F25D 2400/18* (2013.01)

(58) Field of Classification Search
CPC .... F25D 23/02; F25D 23/028; F25D 2400/18; F25D 2323/02

(Continued)

(56) References Cited

U.S. PATENT DOCUMENTS 9,528,748 B2 * 12/2016 Joo ..... F25D 23/02
11,047,613 B1 * 6/2021 Park ..... F25D 23/028

(Continued)

FOREIGN PATENT DOCUMENTS

CN 101131288 A 2/2008
CN 102384627 A 3/2012

(Continued)

*Primary Examiner* — Justin B Rephann
(74) *Attorney, Agent, or Firm* — Cheng-Ju Chiang

(57) ABSTRACT

A refrigerator door with a replaceable door panel, comprising: a rear door body, and a door panel detachably connected to the rear door body; the rear door body comprises a first boss and a first engaging member which are disposed opposite to each other; a rear side of the door panel comprises a link latch and a second engaging member which are disposed opposite to each other; wherein when the door panel is assembled to a front side of the rear door body, one end of the link latch snap-fits with the first boss to limit a displacement of the door panel in an up-down direction; the first engaging member engages the second engaging member to limit a displacement of the door panel in a front-rear direction.

9 Claims, 11 Drawing Sheets

(58) Field of Classification Search
USPC ..... 312/265.6, 405
See application file for complete search history.

(56) References Cited

U.S. PATENT DOCUMENTS

2003/0067254 A1* 4/2003 Manke ..... A47L 15/4265 312/265.6
2011/0025173 A1* 2/2011 Ciyanoglu ..... F25D 23/10 312/204
2012/0073202 A1* 3/2012 Lee ..... F25D 29/005 49/70
2012/0169196 A1* 7/2012 Marchetti ..... E06B 5/006 312/265.6
2014/0184049 A1* 7/2014 Resch ..... A47F 3/0413 312/405
2016/0305706 A1* 10/2016 Lim ..... F25D 23/025
2020/0326119 A1* 10/2020 Lee ..... F25D 23/02
2021/0318061 A1* 10/2021 Lee ..... F25D 23/028
2021/0372688 A1* 12/2021 Kang ..... F25D 23/02
2023/0243580 A1* 8/2023 Song ..... F25D 23/028 62/264
2023/0251020 A1* 8/2023 Li ..... F25D 23/028 49/501
2023/0251021 A1* 8/2023 Li ..... E05B 1/0015 49/501
2023/0258385 A1* 8/2023 Wang ..... F25D 23/02 49/501
2023/0258388 A1* 8/2023 Yu ..... F25D 23/02 312/405

FOREIGN PATENT DOCUMENTS

CN 204177075 U 2/2015
CN 207299701 U 5/2018
CN 209343686 U 9/2019
CN 210105520 U 2/2020
CN 210119057 U 2/2020
CN 210220367 U 3/2020
DE 102013216769 A1 2/2015
KR 10-2016-0099374 A 8/2016

* cited by examiner

REFRIGERATOR DOOR WITH REPLACEABLE DOOR PANEL

CROSS REFERENCE TO RELATED APPLICATIONS

The present application is a 35 U.S.C. § 371 National Phase conversion of International (PCT) Patent Application No. PCT/CN2021/100884, filed on Jun. 18, 2021, which claims the priority of Chinese Application No. 202010623485.5 filed on Jun. 30, 2020, the disclosure of which is incorporated by reference herein. The PCT International Patent Application was filed and published in Chinese.

TECHNICAL FIELD

The present invention relates to the technical field of household appliances, and particularly to a refrigerator door with a replaceable door panel.

BACKGROUND

Along with constant development of science and technology, a refrigerator has already become one of indispensable household appliances. In current application, as the user's demands increase, the refrigerator is also required to exist as a decoration in the household environment in addition to as a household appliance; before buying the refrigerator, the user usually has many requirements for the refrigerator such as color and pattern, and a single appearance of the refrigerator affects the user's buying demands. In addition, since a service life of the refrigerator can usually be in a range of 8 years to 10 years, during use of the refrigerator by the user, the appearance of the refrigerator once bought cannot satisfy the user's demands for long-term adjustment as the environment and scenario change.

In view of the above, how to detachably fix an outer decorative panel to a refrigerator door body becomes a topic that draws attention of the industry.

SUMMARY

An object of the present invention is to provide a refrigerator door with a replaceable door panel, which is capable of achieving a quickly-assembling and disassembling effect.

In order to achieve one of the above object, an embodiment of the present invention provides a refrigerator door with a replaceable door panel, wherein the refrigerator door comprise:

- a rear door body, and a door panel detachably connected to the rear door body;
- the rear door body comprises a first boss and a first engaging member which are disposed opposite to each other;
- a rear side of the door panel facing towards the rear door body comprises a link latch and a second engaging member which are disposed opposite to each other;
- wherein when the door panel is assembled to a front side of the rear door body, one end of the link latch snap-fits with the first boss to limit a displacement of the door panel in an up-down direction; the first engaging member engages the second engaging member to limit a displacement of the door panel in a front-rear direction.

As an optional embodiment, wherein the link latch comprises a first link, a second link and a third link which are pivotally connected in sequence, the first link is pivotally connected to a rear side of the door panel; when the first link rotates to a first position, an end of the first link snap-fits with the first boss, and a connection line between a first pivot center of the first link, a second pivot center of the second link and a third pivot center of the third link is a straight line.

As an optional embodiment, wherein when the first link pivots away from the first position, one end of the first link disengages from the first boss.

As an optional embodiment, wherein the link latch further comprises a pressing column, and the pressing column is disposed at an end of the third link away from the second link, where when the first link pivots to the first position, the pressing column presses the first boss in the up-down direction to limit the displacement of the door panel in the up-down direction.

As an optional embodiment, wherein a box is disposed on the rear door body, the box comprises an opening and a receiving cavity, the first boss has a through hole, and the through hole, the opening and the receiving cavity are communicated to one another; when the first link pivots to the first position, the second link, the third link and the pressing column pass through the through hole and the opening and are received in the receiving cavity.

As an optional embodiment, wherein a hook is disposed at an end of the first link away from the second link; a catching block is disposed on the first boss, and the catching block and the pressing column are respectively disposed on both sides away from the first boss; when the first link pivots to the first position, the hook catches the catching block.

As an optional embodiment, wherein a frame is disposed on a rear side of the door panel, the frame is attached to the door panel, a second boss protrudes from the frame towards the rear door body, the second boss is provided with a recess, and the first link is rotatably disposed in the recess.

As an optional embodiment, wherein the first link is pivotally connected to the frame, a first rotating shaft of the first link is rotatably disposed in a first pivot hole of the frame, and a coil spring is sleeved on the first rotating shaft.

As an optional embodiment, wherein the second engaging member is disposed on the frame, the second engaging member and the link latch are opposite to each other in the up-down direction, and the second engaging member is a hook.

As an optional embodiment, wherein a hook groove is disposed on the front side of the rear door body, the second engaging member is disposed in the hook groove, the first engaging member comprises an elastic pushing portion, where the hook enters the hook groove, and the elastic pushing portion pushes the hook backward.

As compared with the prior art, the present invention provides a refrigerator door with a replaceable door panel. The rear side of the door panel comprises the link latch and the second engaging member which are opposite to each other, and the rear door body comprises the first platform and the first engaging member which are opposite to each other, wherein the link latch snap-fits with the first platform and the second engaging member interacts with the first engaging member, thereby jointly limiting the displacement of the front panel in the up-down direction and the front-rear direction. In addition, the second engaging member and first engaging member may further limit the displacement of the front panel in the left-right direction through structural optimization.

Since the refrigerator door with the replaceable door panel uses simple snap-fitting and fixing structures such as the link, hook and catching block, the assembling stability between the door panel and rear door body in multiple dimensions is achieved. Meanwhile, since snap-fitting and fixing structures are employed and the use of the screw-fastening structure is avoided, the disassembling is made simpler and more convenient.

DETAILED DESCRIPTION

Figure 1:
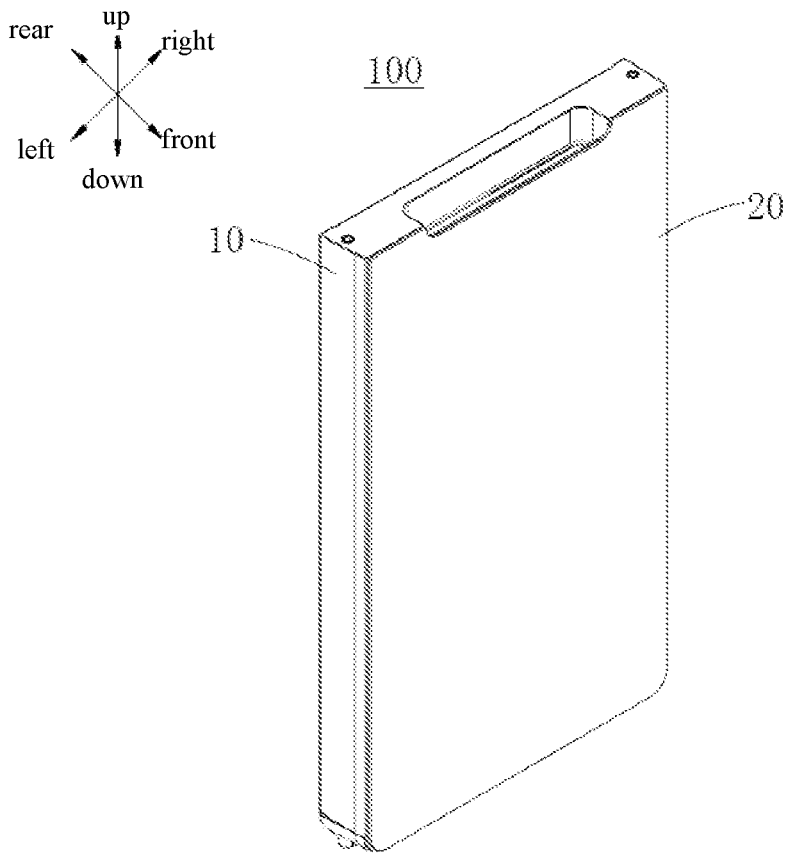
FIG. 1 is a view of a refrigerator door with a replaceable door panel according to the present invention.
Figure 2:
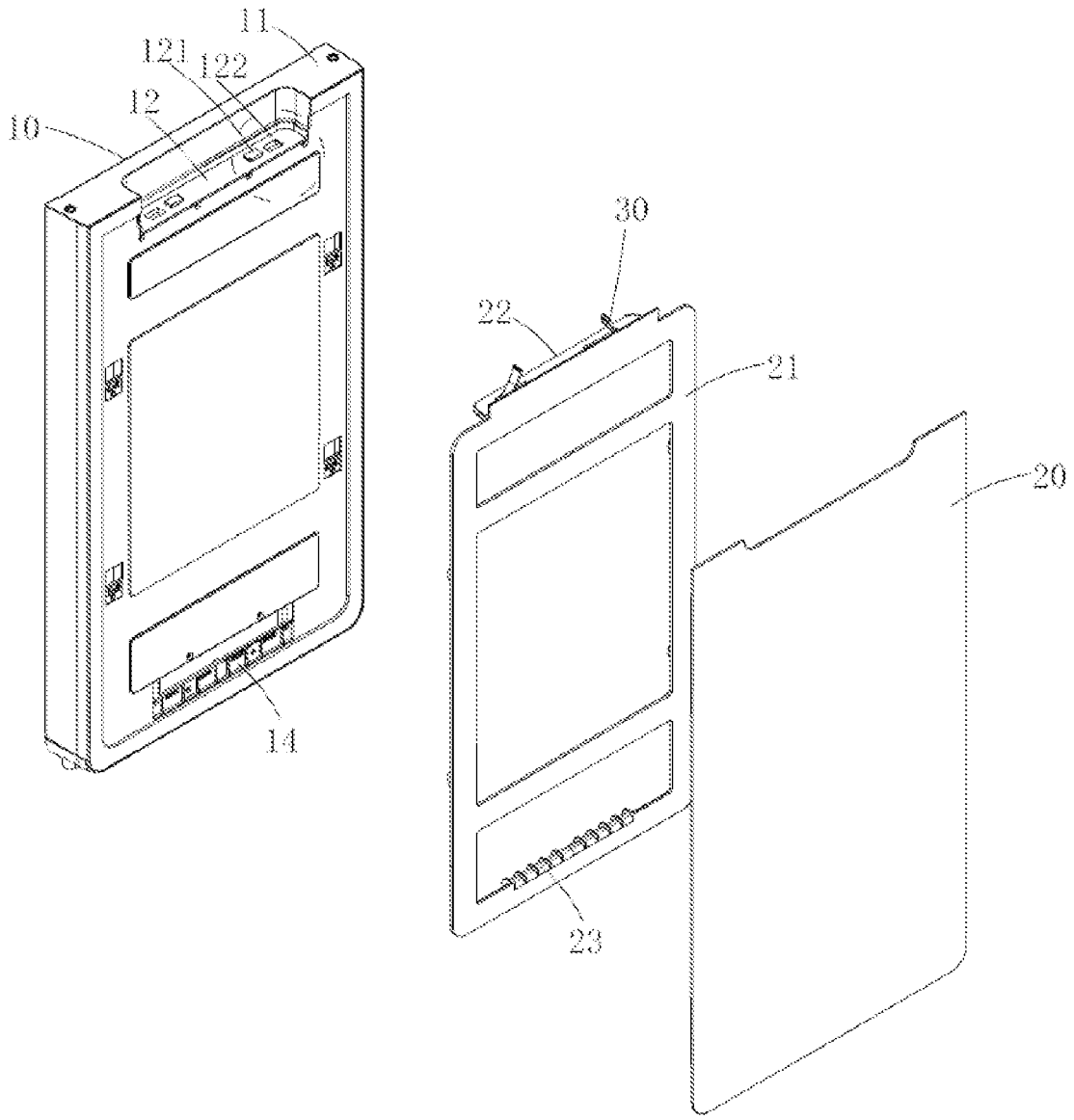
FIG. 2 and FIG. 3 are exploded views of the refrigerator door with a replaceable door panel in FIG. 1 as viewed from different angles of view.
Figure 3:
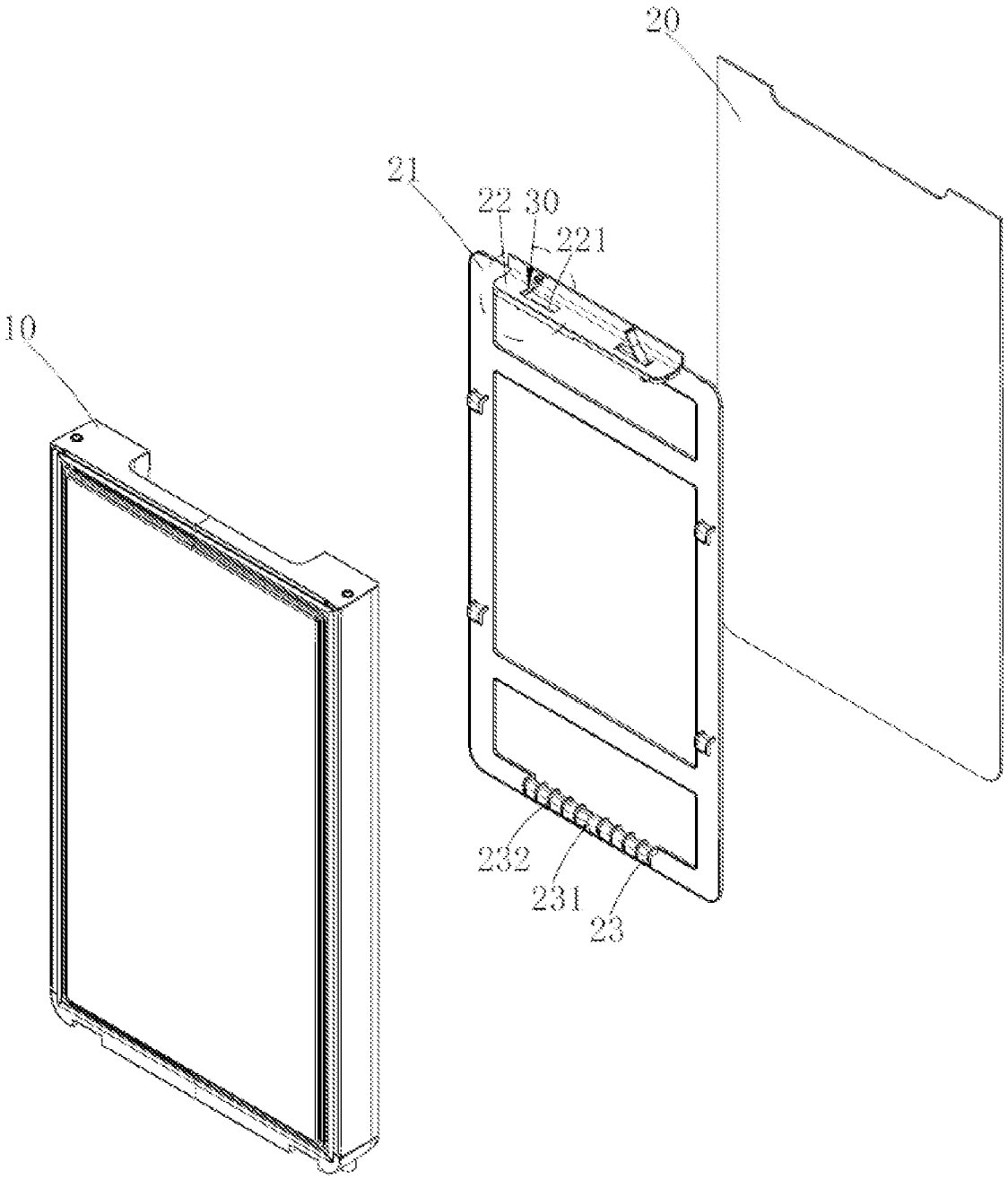

The present invention will be described in detail below in combination with embodiments shown in the figures. However, these embodiments do not limit the present invention, and structural or functional changes made by those having ordinary skill in the art according to these embodiments are all included in the protection scope of the present invention.

As shown in FIG. 1 through FIG. 7B, a refrigerator door 100 with a replaceable door panel comprises: a rear door body 10, and a door panel 20 detachably connected to a front side of the rear door body 10; a front side of the rear door body 10 comprises a first boss 12 and a first engaging member 13 which are disposed opposite to each other; a rear side of the door panel 20 comprises a link latch 30 and a second engaging member 23 which are disposed opposite to each other; when the door panel 20 is assembled to the front side of the rear door body 10, the link latch 30 snap-fits with the first boss 12 to limit a displacement of the door panel 20 in an up-down direction; the second engaging member 23 engages the first engaging member 13 to limit a displacement of the door panel 20 in a front-rear direction.

As shown in FIG. 6 through FIG. 12C, the link latch 30 comprises a first link 31, a second link 32 and a third link 33 which are pivotally connected in sequence. The first link 31 is pivotally connected to a rear side of the door panel 20. When the first link 31 rotates to a first position, an end of the first link 31 snap-fits with the first boss 12. At this time, a connection line between a first pivot center of the first link 31, a second pivot center of the second link 32 and a third pivot center of the third link 33 is a straight line S. At this time, the first link 31, the second link 32 and the third link 33 jointly pivot to "a dead point" position, so the links do rotate therebetween any more and can bear a large acting force. Even though a dead weight of the door panel 20 is large, the door panel 20 may also be stably assembled on the rear door body 10 through the link latch 30, and the door panel 20 does not generate a displacement in the up-down direction, wherein the first link 31 and the first boss 12 snap-fit each other.

Furthermore, when the first link 31 pivots away from the first position, the first link 31 disengages from the first boss 12, so that the limit of the displacement of the door panel 20 in the up-down direction is removed.

In the present embodiment, the link latch 30 is pivotally connected to the rear side of the door panel 10 through the first link 31, and opposite ends of the second link 32 are pivotally connected to the first link 31 and the third link 33, respectively. The first link 31 comprises a first pivot portion 311 and a second pivot portion 312 which are adjacent to each other, the first pivot portion 311 is disposed at an end of the first link 31, the first pivot portion 311 is pivotally connected to the rear side of the door panel 20 through a first rotating shaft 40, the second pivot portion 312 protrudes from a side of the first pivot portion 311, and is pivotally connected with one end of the second link 32, and the other end of the second link 32 is pivotally connected with a middle portion of the third link 33.

The first pivot portion 311 of the first link 31 rotates around the first rotating shaft 40, that is, the first pivot center coincides with the first rotating shaft 40; a second rotating shaft 50 and a third rotating shaft 60 are disposed at opposite ends of the second link 32, respectively, wherein the second rotating shaft 50 causes one end of the second link 32 to pivotally connect with the second pivot portion 312 of the first link 31, and the third rotating shaft 60 causes the other end of the second link 32 to pivotally connect with the middle portion of the third link 33; the second link 32 rotates around the second rotating shaft 50, that is, the second pivot center of the second link 32 coincides with the second rotating shaft 50, and the third link 33 rotates around the third rotating shaft 60, that is, the third pivot center of the third link 33 coincides with the third rotating shaft 60.

In other words, when one end of the first link 31 snap-fits with the first boss 12, the connection line between the first rotating shaft 40, the second rotating shaft 50 and the third rotating shaft 60 coincides with the straight line S.

In addition, one end of the third link 33 is pivotally connected to a rear side of the door panel 20 through a fourth rotating shaft 70, and the other end of the third link 33 is provided with a pressing column 34. When the link latch 30 is at the first position, the pressing column 34 pushes the first boss 12 in the up-down direction. In the present embodiment, the pressing column 34 of the third link 33 and a hook 313 of the first link 31 are respectively located on upper and lower sides of the first boss 12. The hook 313 catches the first boss 12 downward, and the pressing column 34 pushes the first boss 12 upward; Alternatively, in other embodiments of the present invention, the hook catches the first boss upward, and the pressing column pushes the first boss downward.

As shown in FIG. 3 through FIG. 7A, a frame 21 is disposed on the rear side of the door panel 20, a second boss 22 protrudes from the frame 21 towards the rear door body, and an extension direction of the second boss 22 is opposite to the extension direction of the first boss on the front side of the rear door body 10. In the present embodiment, the frame 21 is attached to the rear side of the door panel 20 to form a whole with the door panel 20, wherein the link latch 30 is pivotally connected to the second boss 22.

Figure 5:
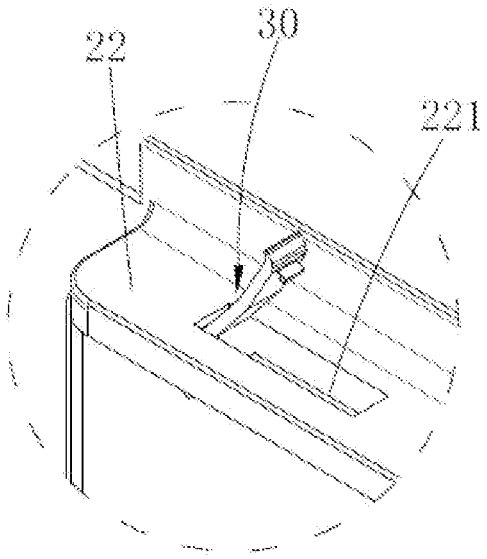
FIG. 5 is an enlarged view of a dashed region in FIG. 3.
Figure 6:
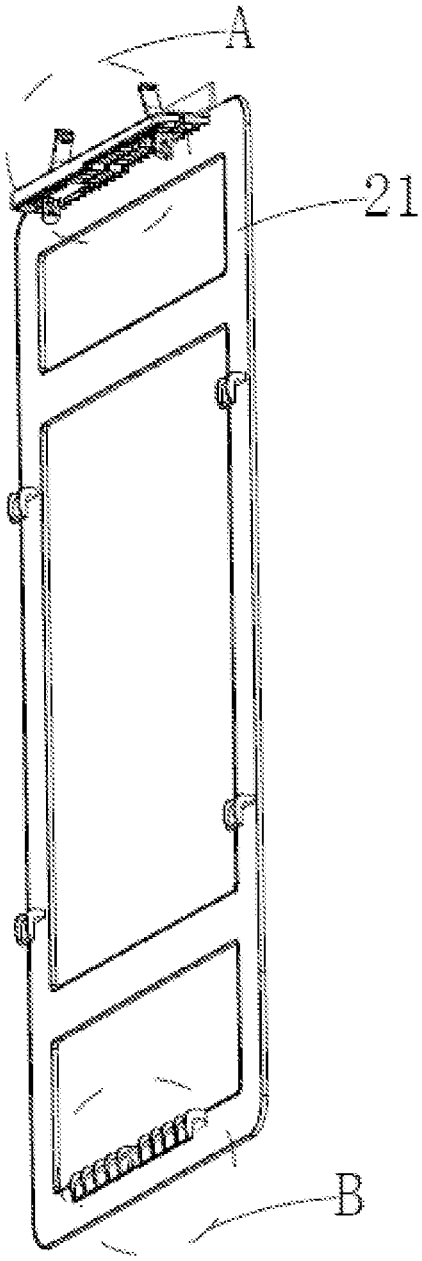
FIG. 6 is a view of a frame in FIG. 3 as viewed from another view of angle.
Figure 7A:
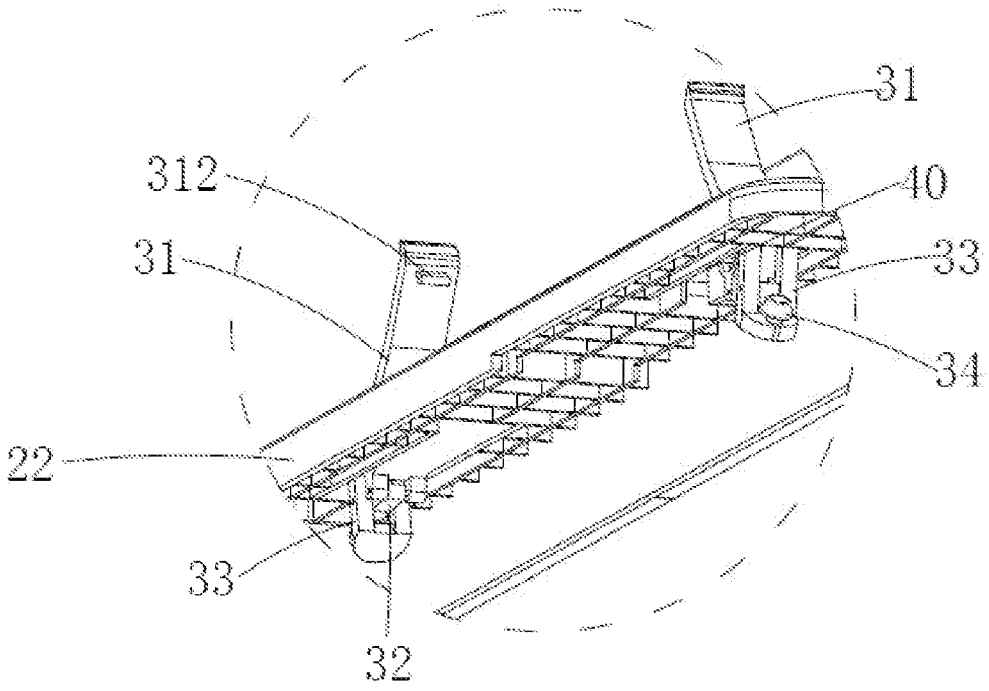
FIG. 7A and FIG. 7B are enlarged views of a dashed region A and a dashed region B in FIG. 6.

As shown in FIG. 5, FIG. 6 and FIG. 7A, the second boss 22 is a plate-shaped structure, and provided with an assembling hole 221 corresponding to the link latch 30. The assembling hole 221 runs through the second boss 22 in the up- and down direction, and the link latch 30 is partially pivotally connected in a hole wall 222 of the assembling hole 221.

Specifically, the assembling hole 221 comprises hole walls 222 opposite in the front-rear direction. The first rotating shaft 40 passes through a pivot hole on the first pivot portion 311 of the first link 31, and its both ends are respectively inserted into first rotating shaft holes on the hole walls 222; opposite ends of the third link 33 adjacent to the fourth rotating shaft 70 at one end of the second boss 22 are respectively inserted into second rotating shaft holes on the hole walls 222; At this time, the first link 31, the second link 32, the third link 33 and the hole wall 222 jointly form a "four-link structure".

Therefore, when the first link 31 in the "four-link structure" is rotated to the first position, the first link 31 snap-fits with the first boss 12, and the connection line between the first pivot center of the first link 31, the second pivot center of the second link 32 and the third pivot center of the third link is on the same straight line. At this time, the third link 33 cannot rotate around the third rotating shaft 60, so that the links will not continue to rotate relative to each other, The "four-link structure" is at the "dead point position", so that the link latch 30 is locked on the first boss 12.

In the present embodiment, a width of the assembling hole 221 in the left-right direction is greater than a length of the first link 31 in the left-right direction. When the first link 32 rotates, it passes through the assembling hole 221 and snap-fits with the first boss 12.

In addition, when the link latch 30 is in an initial state, the first link 31 protrudes from an upper side of the assembling hole 221, and the second link 32 and the third link 33 protrude from a lower side of the assembling hole 221. However, the arrangement of the first, second and third links is not limited thereto. In other embodiments of the present invention, the first link protrudes from the lower side of the assembling hole, and the second link and the third link protrude from the upper side of the assembling hole.

Figure 4:
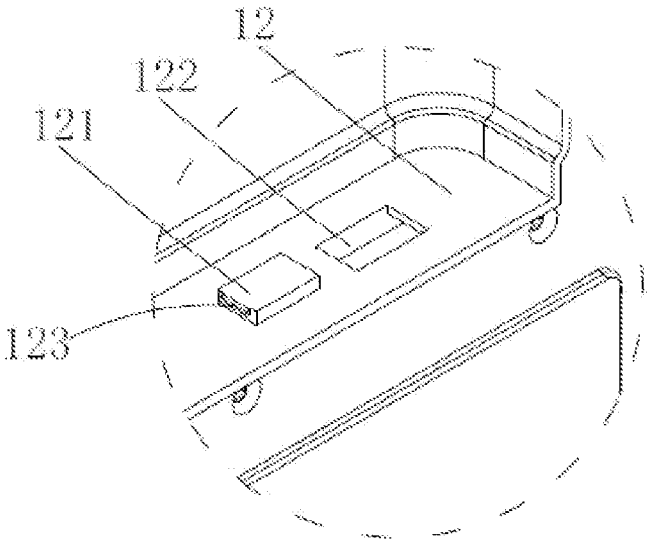
FIG. 4 is an enlarged view of a dashed region in FIG. 2.
Figure 9:
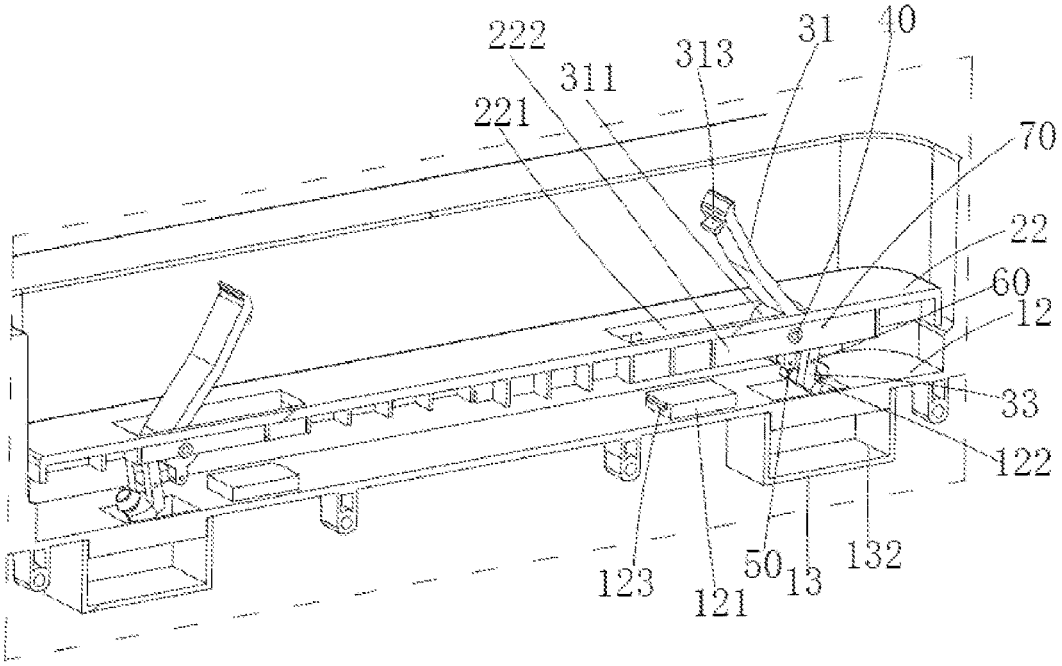
FIG. 9 is a cross-sectional view of the refrigerator door with a replaceable door panel of FIG. 8 as viewed from front.
Figure 10:
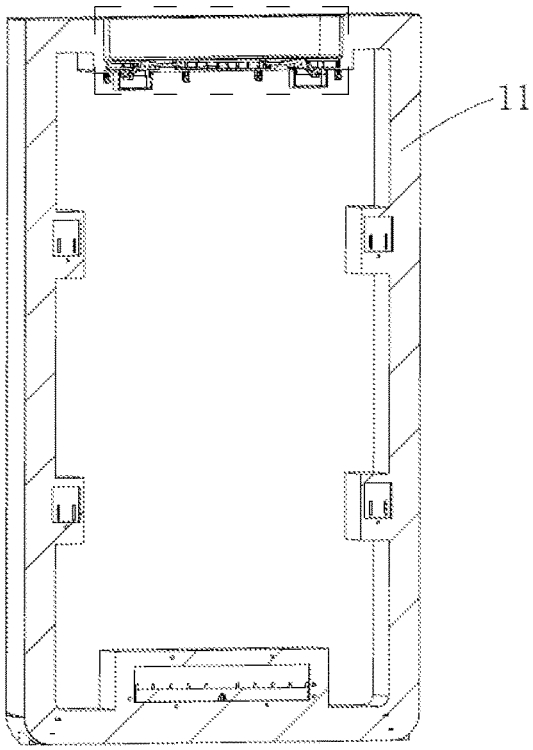
FIG. 10 is a cross-sectional view of the refrigerator door with a replaceable door panel of FIG. 1 as viewed from front.
Figure 11:
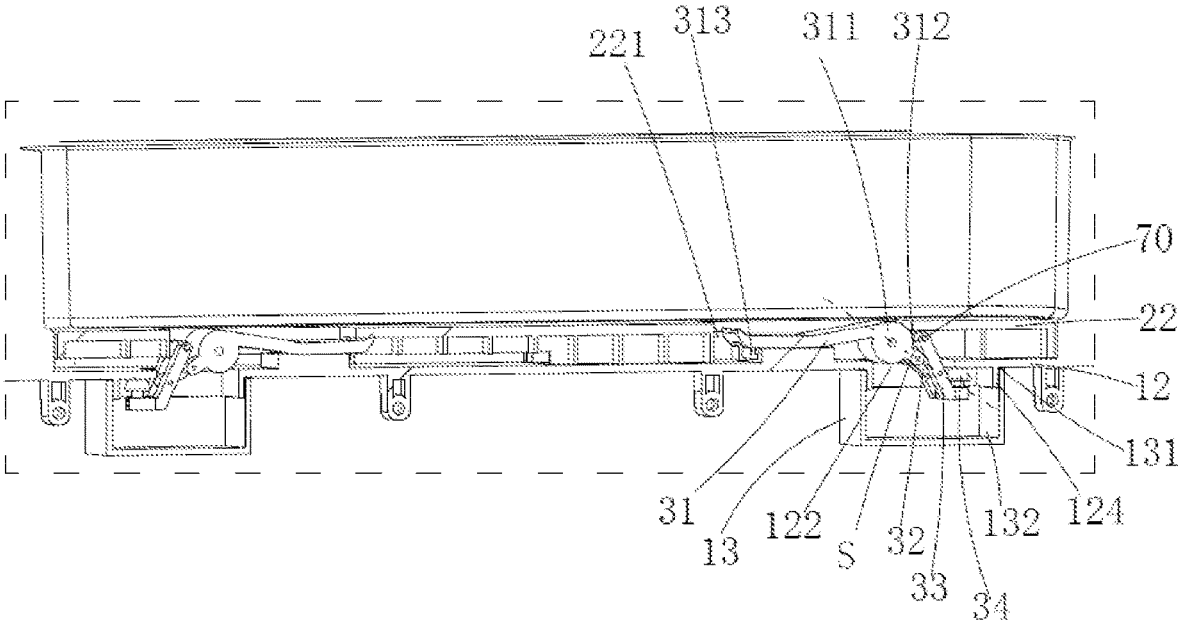
FIG. 11 is an enlarged view of a dashed region in FIG. 10.

As shown in FIG. 4, FIG. 9 and FIG. 11, the first link 31 comprises a hook 313, a catching block 121 is disposed on the first boss 12, and a snap-fitting protrusion 123 is disposed on the catching block 121. When the first link 31 snap-fits with the first boss 12, the hook 313 and the snap-fitting protrusion 123 snap-fit with each other.

As shown in FIG. 11, when the door panel 20 is assembled on the front side of the rear door body 10, the second boss 22 and the first boss 12 are superposed each other, and the catching lock 121 enters the assembling hole 222.

In addition, a box 13 for receiving the second link 32, the third link 33 and the pressing column 34 of the link latch 30 is disposed on an underside of the first boss 12. The box 13 comprises an opening 131 and a receiving cavity 132; the first boss 12 is provided with a through hole 122 communicated with the box 13; the through hole 122 is communicated with the opening 131, and then the through hole 122 is communicated with the receiving cavity 132.

As shown in FIG. 9 and FIG. 11, the second link 32, the third link 33 and the pressing column 34 of the link latch 30 pass through the through hole 122 and the opening 131 into the receiving cavity 132 in the up-down direction. The effect of protecting the link latch 30 may be achieved by providing on the underside of the first boss 12 the box 13 having the receiving cavity 132 to receive the second link 32, the third link 33 and the pressing column 34.

As shown in FIG. 11, an extension portion 124 extends from the underside of the first boss 12; when the box 13 is assembled on the underside of the first boss 12, the extension portion 124 enters the receiving cavity 132 through the opening 131, and the extension portion 124 closely fits with the inner wall of the box body 13 to prevent the box 13 from disengaging from the underside of the first boss 12. The opening 131 of the box 13 abuts against the underside of the first boss 12.

In other embodiments of the present invention, the box may also be integrally formed with the first boss, thereby fundamentally overcoming the instable connection between the box and the first boss.

In addition, the box 13 in the refrigerator door with the replaceable door panel shown in FIG. 9 and FIG. 11 is formed on the underside of the first boss 12, but the arrangement of the box 13 is not limited to this. In other embodiments of the present invention, the box may also be formed on an upper side of the first boss, and preferably may be integrally formed with the first boss.

As can be seen from FIG. 9 and FIG. 11, the first link 31 rotates around the first rotating shaft 40. When the first link 31 rotates to the first position, the hook 313 at the end of the first link 31 snap-fits with the snap-fitting protrusion 123 of the catching block 121 on the first boss 12.

Preferably, the first rotating shaft 40 passes through the pivot hole of the first pivot portion 311 of the first link 31, wherein, an elastic member (not shown) is sleeved on the outside of the first rotating shaft 40. The elastic member is for example a coil spring, which provides an elastic force to make the first link 31 more stable without shaking when rotating around the first rotating shaft 40, thereby improving the stability of the link latch 30.

In a preferred embodiment, the first boss 12 on the front side of the rear door body 10 may be regarded as a rear handle, and the second boss 22 on the frame 21 on the rear side of the door panel 20 may be regarded as a front handle. After the door panel 20 and the rear door body 10 are assembled, the first boss 12 and the second boss 22 are superposed in the up-down direction, wherein the first boss 12 and the second boss 22 may jointly constitute a hidden handle of the refrigerator door with the replaceable door panel.

Figure 7B:
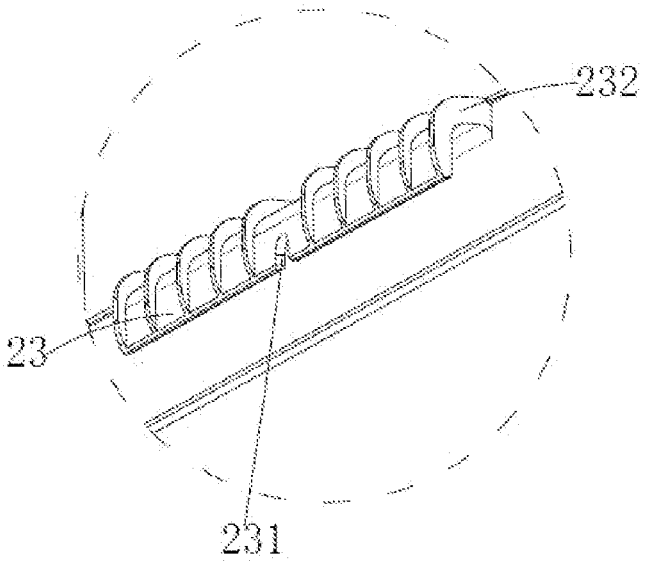
Figure 8:
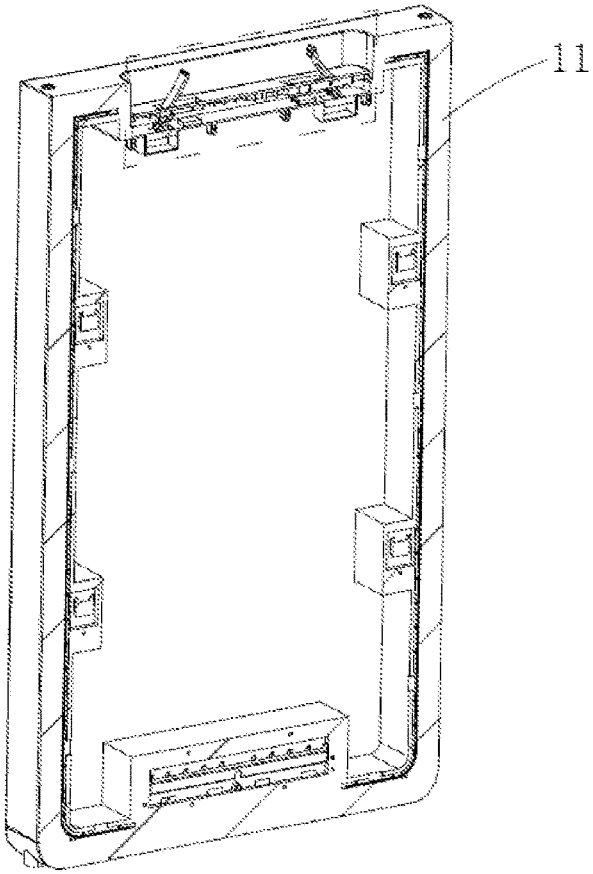
FIG. 8 is a view showing a link latch of a refrigerator door with a replaceable door panel according to the present invention is in an open state.

Further referring to FIG. 6 and FIG. 7B, a lower portion of the frame 21 further comprises a second engaging member, which is opposite to the link latch 30 in the up-down direction. Preferably, the second engaging member is a hook 23.

Corresponding to the hook 23, a hook groove 12 is disposed on the front side of the door body 10, and a first engaging member 15 is disposed in the hook groove 13. Preferably, the first engaging member 15 pushes the hook 23 backward in the front-rear direction, and the hook 23 falls into the hook groove 12 and moves towards the rear side of the hook groove 12, so that the door panel 20 is attached to the front side of the rear door body 10, thereby eliminating a gap between the door panel 20 and the rear door body 10, and improving the aesthetic degree of the refrigerator door 100 with the replaceable door panel.

In the present embodiment, the rear door body 10 comprises a peripheral trim strip 11, and the hook groove 14 may be formed in the peripheral trim strip 11. Preferably, the hook groove 14 may be integrally formed with the peripheral trim strip.

Figure 12A:
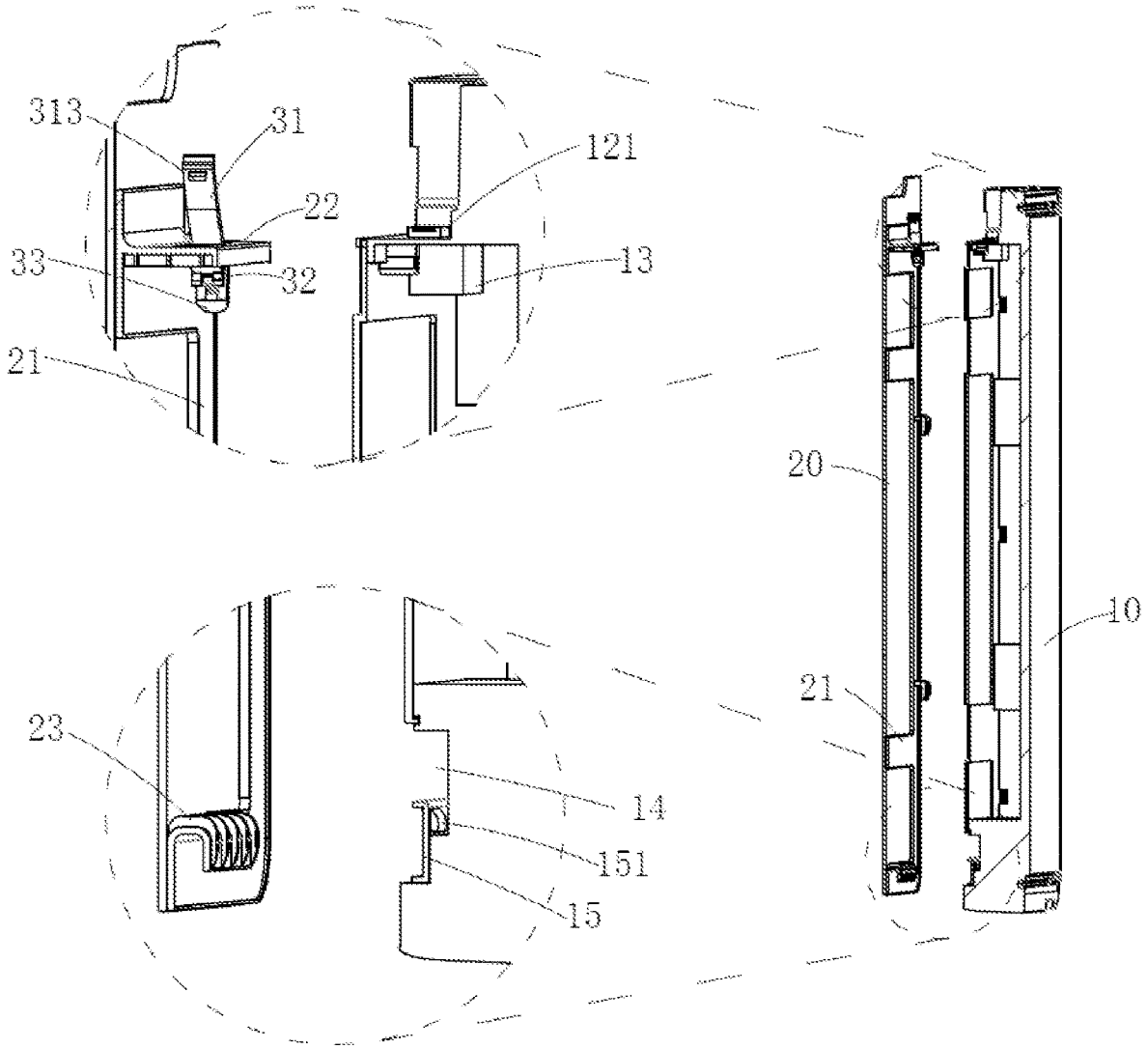
FIG. 12A through FIG. 12C are cross-sectional views of a refrigerator door with a replaceable door panel according to the present invention during assembling.
Figure 12B:
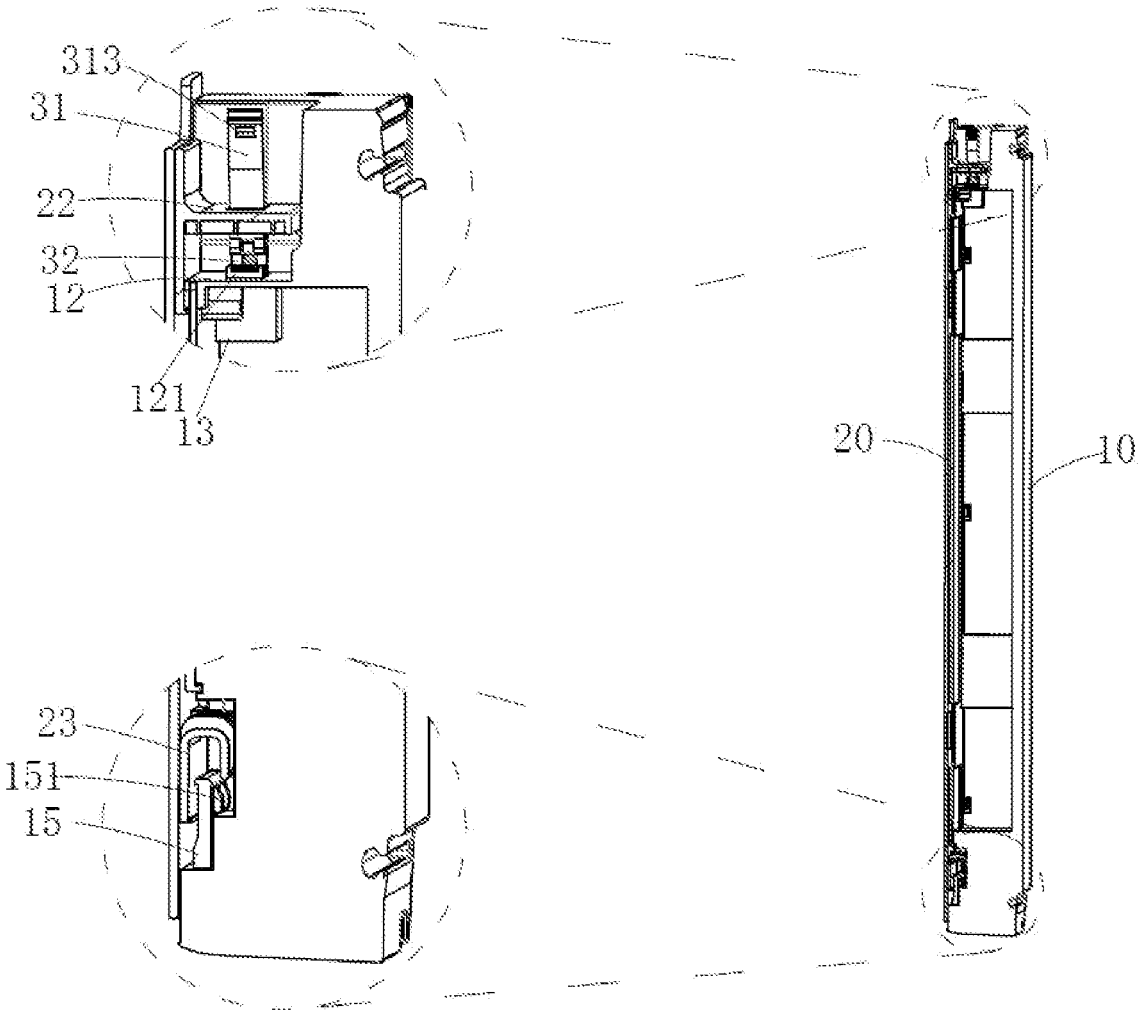
Figure 12C:
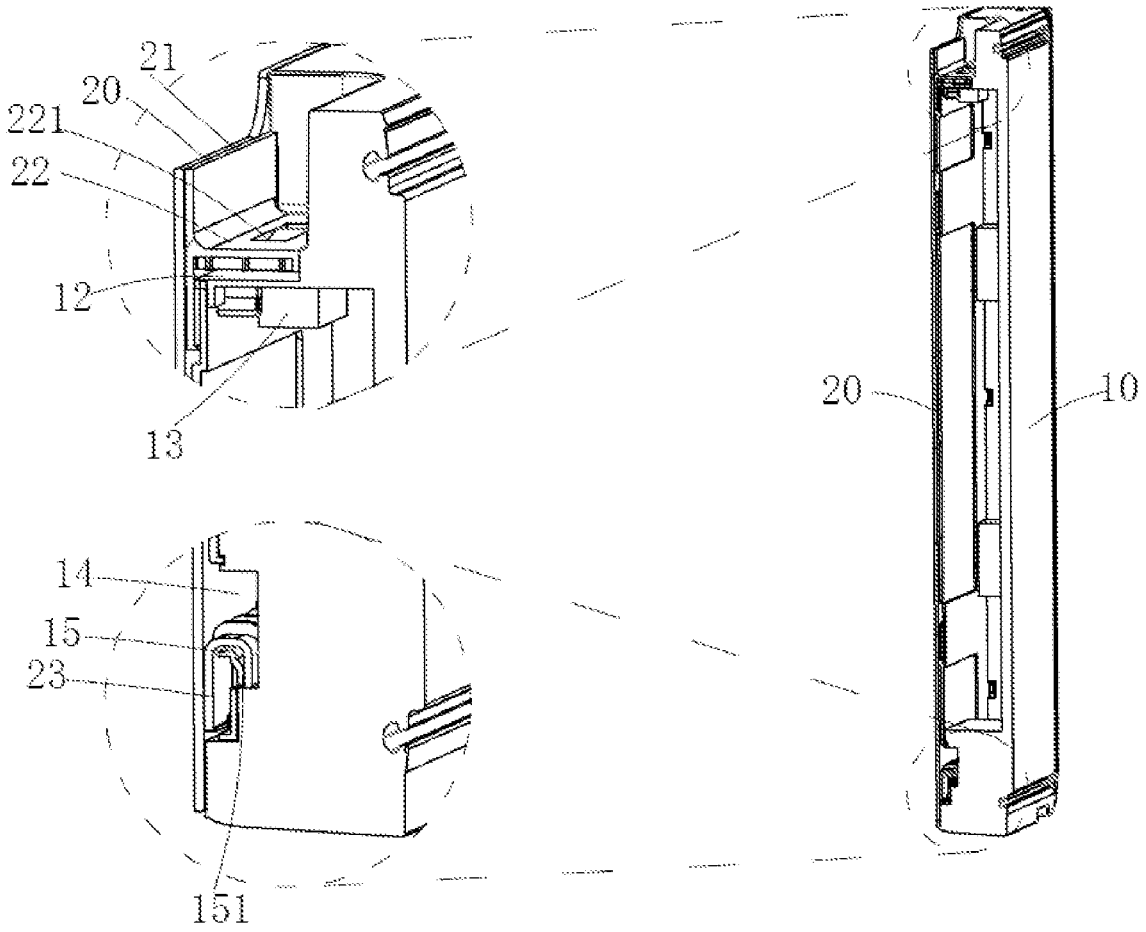

As shown in FIG. 12C, the first engaging member 15 comprises an elastic pushing portion 151, which projects towards the rear side of the hook groove 12. The elastic pushing portion 151 is a cantilever formed on the rear side of the first engaging member 15. There is a gap between the cantilever and the first engaging member 15. The gap may provide a space for elastic deformation of the cantilever, so that the cantilever may deform and generate an elastic force, and the elastic force may be released to push a resisting surface on a front side of a bent portion of the hook 23 elastically backward.

As shown in FIG. 7B, a plurality of reinforcing ribs 232 protrude from a rear side surface of the hook 23, and are used to improve the strength of the hook 23 and the load-bearing capacity of the hook 23.

In addition, a positioning recess 231 is disposed at a central area of an edge of the bent portion of the hook 23, and the positioning recess 231 and a positioning bump (not shown) on a rear groove wall of the hook groove 12 are adapted for each other, wherein the hook 23 is inserted into the hook groove 12, the elastic pushing portion 151 elastically pushes the hook 23 to move towards the rear groove wall of the hook groove 12, and the positioning recess 231 on the hook 23 snap-fits with the positioning bump on the rear groove wall, thereby limiting a displacement of the hook 23 in the left-right direction.

It can be seen from the above that after the assembling of the refrigerator door 100 with the replaceable door panel provided by the present invention is completed, the hook of the first link 31 of the link latch 30 on the rear side of the door panel 20 snap-fits with the snap-fitting projection 123 of the catching block 121 on the first platform 12 on the front side of the rear door body 10 to limit the displacement of the door panel 20 in the up-down direction; the elastic pushing portion 151 of the first engaging member 15 in the hook groove 12 of the rear door body 10 pushes the hook 23 on the rear side of the door panel 20 backward elastically to limit the displacement of the door panel 20 in the front-rear direction; the positioning recess 231 on the hook 23 snap-fits with the positioning bump on the rear groove wall of the hook groove 12 to limit the displacement of the door panel 20 in the left-right direction; therefore, the displacement of door panel 20 in three dimensions is limited, thereby making the engagement of door panel 20 and the rear door body 10 more stable.

It needs to be appreciated that in other embodiments of the present invention, the first engaging member and second engaging member may also be a magnet and a ferromagnetic element, respectively, and the mutual magnetic attraction of magnet and ferromagnetic element may limit the displacement of the door panel in the front-back direction.

The assembling and disassembling process of door panel 20 and the rear door body 10 in refrigerator door 100 with the replaceable door panel will be described below with reference to FIG. 12A through FIG. 12C.

It needs to be appreciated that that the rear side of the door panel 20 has already been fitted to the frame 21 before the door panel 20 is assembled to the rear door body, i.e., the door panel 20 and the frame 21 are assembled to the front side of the rear door body 10 as a whole.

The assembling process comprises:

As shown in FIG. 12A and FIG. 12B, first, the door panel 20 is moved toward the rear door body 10, and the door panel 20 is controlled at a position slightly higher than the rear door body 10. At this time, the second platform 22 is located above the first platform 12, and the hook 23 is inserted into an upper portion of the hook groove 12; as shown in FIG. 12C, next, the door panel 20 is moved downward in the up-down direction, and the second link 32, the third link 33 and the pressing column 34 of the link latch 30 enter the receiving cavity 132 through the through hole 122 on the first platform 12 and the opening 131 of the box 13; At this time, the hook 23 falls into the hook groove 12 and moves towards the bottom of the hook groove 12. The elastic pushing portion 151 of the first engaging member 15 pushes backward the resisting surface inside the bent portion of the hook 23. The door panel 20 is attached to the front side of the rear door body 10, and thus the displacement of the door panel 20 in the front-rear direction is limited.

In addition, the hook 23 moves towards the rear side of the hook groove 12, and the positioning recess 231 engages the positioning bump of the rear groove wall of the hook groove 12, so that the displacement of the door panel 20 in the left-right direction is limited.

Further referring to FIG. 12C with reference to FIG. 9 and FIG. 11, finally, the first link 31 of the link latch 30 is turned. The first pivot portion 311 of the first link 31 turns downward (or clockwise) around the first rotating shaft 40. The hook 313 on one end of the first link 31 moves into the assembling hole 221 of the second boss 22, and the hook 313 snap-fits with the snap-fitting projection 123 of the catching block 121 on the first boss 12 received in the assembling hole 221. At this time, the first link 31 is at the first position, wherein the pressing column 34 on the third link 33 pushes the first boss 12 upward, the third link 33 is at the locked position, and thereby the link latch 30 is in the locked state. The displacement of the door panel 20 in the up-down direction is limited.

The disassembling process comprises:

First, one end of the first link 31 is lifted upward, and the first link 31 leaves the first position, so that the hook 313 disengages from the snap-fitting projection 123, wherein the first pivot portion 311 of the first link 31 turns upward (or counterclockwise) around the first rotating shaft 40, and the second pivot portion 312 of the first link 31 drives one end of the second link 32 to turn downward (or clockwise) around the second rotating shaft 50; the opposite other end of the second link 32 moves downward and drives the middle portion of the third link 33 to turn downward (or clockwise) around the third rotating shaft 60; when the middle portion of the third link 33 turns downward around the third rotating shaft 60, the pressing column 34 on one end of the third link 33 located below the second platform 22 is driven to move downward and no longer pushes against the underside of the first platform 12. At this time, the engagement between the link latch 30 and the first platform 12 is completely removed, and then the displacement of the door panel 10 in the up-down direction is removed.

Secondly, the front panel is pushed upward in the up-down direction, and the link latch 30 passes through the through hole on the first platform 12 and disengages from the first platform 12 (as shown in FIG. 12B); the hook 23 moves upward along the rear groove wall of the hook groove 12, the positioning recess 231 of the hook 23 disengages from the positioning bump on the rear groove wall, and the elastic pushing portion 151 of the first engaging member 15 no longer pushes against the resisting surface inside the bent portion of the hook 23 (as shown in FIG. 12B); at this time, the limitation of the door panel 20 in the left-right direction and the front-rear direction is removed, so the door panel 20 may be directly removed from the rear door body 10.

As known from the above, the assembling and disassembling of the refrigerator door 100 with the replaceable door panel only involves the interaction of the hook 23 of the door panel 20, the hook groove 12 and the first engaging member 15 of the rear door body 10, and the interaction of the link latch 30 of the door panel 20 and the first platform 12 of the rear door body 10. Since the hook 23, the link latch 30, the hook groove 12, the first engaging member 15 and the first platform 12 are simple structures, the above assembling and disassembling are very simple and convenient, and the effect of quick assembling and disassembling can be achieved.

To sum up, the present invention provides a refrigerator door with a replaceable door panel. The rear side of the door panel comprises the link latch and the second engaging member which are opposite to each other, and the rear door body comprises the first platform and the first engaging member which are opposite to each other, wherein the link latch snap-fits with the first platform and the second engaging member interacts with the first engaging member, thereby jointly limiting the displacement of the front panel in the up-down direction and the front-rear direction. In addition, the second engaging member and first engaging member may further limit the displacement of the front panel in the left-right direction through structural optimization.

Since the refrigerator door with the replaceable door panel uses simple snap-fitting and fixing structures such as the link, hook and catching block, the assembling stability between the door panel and rear door body in multiple dimensions is achieved. Meanwhile, since snap-fitting and fixing structures are employed and the use of the screw-fastening structures is avoided, the disassembling is made simpler and more convenient.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator door with a replaceable door panel, wherein the refrigerator door comprises:

a rear door body, and a door panel detachably connected to the rear door body;

the rear door body comprises a first boss and a first engaging member which are disposed opposite to each other;

a rear side of the door panel facing towards the rear door body comprises a link latch and a second engaging member which are disposed opposite to each other;

wherein when the door panel is assembled to a front side of the rear door body, one end of the link latch snap-fits with the first boss to limit a displacement of the door panel in an up-down direction; the first engaging member engages the second engaging member to limit a displacement of the door panel in a front-rear direction;

wherein the link latch comprises a first link, a second link and a third link which are pivotally connected in sequence, the first link is pivotally connected to the rear side of the door panel;

when the first link rotates to a first position, an end of the first link is configured as the one end of the link latch which snap-fits with the first boss, and a connection line between a first pivot center of the first link, a second pivot center of the second link and a third pivot center of the third link is a straight line.

2. The refrigerator door with a replaceable door panel according to claim 1, wherein when the first link pivots away from the first position, the end of the first link disengages from the first boss.

3. The refrigerator door with a replaceable door panel according to claim 1, wherein the link latch further comprises a pressing column, and the pressing column is disposed at an end of the third link away from the second link, where when the first link pivots to the first position, the pressing column presses the first boss in the up-down direction to limit the displacement of the door panel in the up-down direction.

4. The refrigerator door with a replaceable door panel according to claim 3, wherein a box is disposed on the rear door body, the box comprises an opening and a receiving cavity, the first boss has a through hole, and the through hole, the opening and the receiving cavity are communicated to one another; when the first link pivots to the first position, the second link, the third link and the pressing column pass through the through hole and the opening and are received in the receiving cavity.

5. The refrigerator door with a replaceable door panel according to claim 3, wherein a hook is disposed at an end of the first link away from the second link; a catching block is disposed on the first boss, and the catching block and the pressing column are respectively disposed on both sides away from the first boss; when the first link pivots to the first position, the hook catches the catching block.

6. The refrigerator door with a replaceable door panel according to claim 1, wherein a frame is disposed on the rear side of the door panel, the frame is attached to the door panel, a second boss protrudes from the frame towards the rear door body, the second boss is provided with a recess, and the first link is rotatably disposed in the recess.

7. The refrigerator door with a replaceable door panel according to claim 6, wherein the first link is pivotally connected to the frame, a first rotating shaft of the first link is rotatably disposed in a first pivot hole of the frame, and a coil spring is sleeved on the first rotating shaft.

8. The refrigerator door with a replaceable door panel according to claim 6, wherein the second engaging member is disposed on the frame, the second engaging member and the link latch are opposite to each other in the up-down direction, and the second engaging member is a hook.

9. The refrigerator door with a replaceable door panel according to claim 8, wherein a hook groove is disposed on the front side of the rear door body, the second engaging member is disposed in the hook groove, the first engaging member comprises an elastic pushing portion, where the hook enters the hook groove, and the elastic pushing portion pushes the hook backward.

* * * * *